US011387561B2

(12) United States Patent
Shailendra et al.

(10) Patent No.: US 11,387,561 B2
(45) Date of Patent: Jul. 12, 2022

(54) ANTENNA

(71) Applicant: FUJIKURA LTD., Tokyo (JP)

(72) Inventors: Kaushal Shailendra, Sakura (JP); Ning Guan, Sakura (JP)

(73) Assignee: FUJIKURA LTD., Tokyo (JP)

( * ) Notice: Subject to any disclaimer, the term of this patent is extended or adjusted under 35 U.S.C. 154(b) by 51 days.

(21) Appl. No.: 17/040,581

(22) PCT Filed: Mar. 25, 2019

(86) PCT No.: PCT/JP2019/012549
§ 371 (c)(1),
(2) Date: Sep. 23, 2020

(87) PCT Pub. No.: WO2019/189005
PCT Pub. Date: Mar. 10, 2019

(65) Prior Publication Data

US 2021/0075112 A1 Mar. 11, 2021

(30) Foreign Application Priority Data

Mar. 30, 2018 (JP) ..... JP2018-066399

(51) Int. Cl.
*H01Q 9/04* (2006.01)
*H01Q 21/00* (2006.01)
(Continued)

(52) U.S. Cl.
CPC ..... *H01Q 9/0457* (2013.01); *H01Q 1/48* (2013.01); *H01Q 21/0006* (2013.01); *H01Q 21/08* (2013.01)

(58) Field of Classification Search
CPC ..... H01Q 9/04; H01Q 9/0407; H01Q 9/045; H01Q 9/0457; H01Q 21/0006;
(Continued)

(56) References Cited

U.S. PATENT DOCUMENTS 9,935,065 B1 * 4/2018 Baheti ..... H01L 23/66
9,985,346 B2 * 5/2018 Baks ..... H01L 23/66
(Continued)

FOREIGN PATENT DOCUMENTS

JP 2010-16789 A 1/2010
JP 2017-46107 A 3/2017

OTHER PUBLICATIONS

International Search Report dated Jun. 11, 2019, issued in counterpart International Application No. PCT/JP2019/012549 (3 pages, including Japanese original and English translation).
(Continued)

*Primary Examiner* — Jason Crawford
(74) *Attorney, Agent, or Firm* — WHDA, LLP

(57) ABSTRACT

A dielectric loss when a signal wave is transmitted between a feed line and an antenna element via a slot is reduced. An antenna 21 includes: a dielectric substrate 28 including a recess 28*b*; a conductive ground layer 27 that is bonded to the dielectric substrate 28 to cover the recess 28*b*, and includes slots 27*a*-27*d* arranged on an inner side relative to the recess 28*b*; a dielectric layer 26 bonded to the conductive ground layer 27 on a side opposite to the dielectric substrate 28 relative to the conductive ground layer 27; antenna elements 29*a*-29*d* formed on a bottom 28*d* of the recess 28*b* at positions facing the slots 27*a*-27*d*; and a feed line 24*a* that is formed on a side opposite to the conductive ground layer 27 relative to the dielectric layer 26, and is to be electromagnetically coupled to the antenna elements 29*a*-29*d* via the slots 27*a*-27*d*.

4 Claims, 23 Drawing Sheets

(51) Int. Cl.
*H01Q 1/48* (2006.01)
*H01Q 21/08* (2006.01)

(58) Field of Classification Search
CPC ..... H01Q 21/06; H01Q 21/061; H01Q 5/378; H01Q 5/385; H01Q 13/10; H01Q 13/18
See application file for complete search history.

(56) References Cited

U.S. PATENT DOCUMENTS

| | | | | |
|---|---|---|---|---|
| 10,283,832 | B1 * | 5/2019 | Chayat | H01Q 9/0407 |
| 10,840,578 | B2 * | 11/2020 | Yu | H01Q 21/0087 |
| 11,056,771 | B2 * | 7/2021 | Jia | H01Q 9/0414 |
| 2010/0001906 | A1 * | 1/2010 | Akkermans | H01Q 9/0457 343/770 |
| 2010/0190464 | A1 * | 7/2010 | Chen | H01L 23/66 438/106 |
| 2012/0212384 | A1 * | 8/2012 | Kam | H01Q 1/2283 343/834 |
| 2014/0253400 | A1 * | 9/2014 | Tiezzi | H01Q 9/0457 343/770 |
| 2015/0129668 | A1 | 5/2015 | Kam et al. | |
| 2017/0271758 | A1 | 9/2017 | Nair et al. | |
| 2018/0331432 | A1 | 11/2018 | Kawaguchi et al. | |
| 2019/0363432 | A1 * | 11/2019 | Hayashi | H01Q 21/06 |
| 2020/0067193 | A1 * | 2/2020 | Zhinong | H01Q 5/50 |
| 2020/0212585 | A1 * | 7/2020 | Chayat | H01Q 5/378 |
| 2020/0313299 | A1 * | 10/2020 | Jia | H01Q 9/0457 |
| 2021/0075112 | A1 * | 3/2021 | Shailendra | H01Q 21/0037 |
| 2021/0075113 | A1 * | 3/2021 | Shailendra | H01Q 9/0457 |
| 2021/0336316 | A1 * | 10/2021 | Raphaeli | H01Q 21/08 |

OTHER PUBLICATIONS

Notice of Reasons for Refusal dated Nov. 25, 2019, issued in counterpart JP application No. 2018-066399, with English translation (9 pages).

* cited by examiner

ANTENNA

TECHNICAL FIELD

The present disclosure relates to an antenna.

BACKGROUND ART

Patent Literature 1 discloses a slot antenna of a triplate line feeding system. Specifically, a feed line is formed between two dielectric layers, a front conductive foil is formed on a front surface of one of the dielectric layers, a back conductive foil is formed on a back surface of the other dielectric layer, and a slot is formed in the front conductive foil. The feed line is wired from a transmitter and receiver circuit to the position facing the center of the slot.

Further, a slot-coupled patch antenna of a triplate line feeding system has also been generally known. In the slot-coupled patch antenna, a dielectric layer is further formed on the foregoing front conductive foil, a patch antenna element is formed on the dielectric layer such that the antenna element faces the foregoing slot. Thus, the antenna element is configured to be electromagnetically coupled to the feed line through the slot.

CITATION LIST

Patent Literature

[Patent Literature 1] Japanese Patent Application Publication No. 2017-46107

SUMMARY OF INVENTION

Technical Problem

In a conventional slot-coupled patch antenna of a triplate line feeding system, when a signal wave is transmitted between a feed line and an antenna element, a dielectric loss occurs in a dielectric layer between the antenna element and a conductive foil. Such a dielectric loss causes a decrease in gain.

Thus, the present disclosure has been achieved in view of the circumstances described above. An object of the present disclosure is to reduce a dielectric loss when a signal wave is transmitted between a feed line and an antenna element via a slot.

Solution to Problem

A primary aspect of the present disclosure to achieve the aforementioned object is an antenna comprising: a dielectric substrate including a recess; a conductive ground layer bonded to the dielectric substrate so as to cover the recess, the conductive ground layer including a slot that is arranged on an inner side with respect to the recess; a dielectric layer bonded to the conductive ground layer on a side opposite to the dielectric substrate with respect to the conductive ground layer; an antenna element formed on a bottom of the recess at position facing the slot; and a feed line formed on a side opposite to the conductive ground layer with respect to the dielectric layer, the feed line configured to be electromagnetically coupled to the antenna element via the slot.

Other features of the present disclosure are made apparent from the following description and the drawings.

Advantageous Effects of Invention

According to an embodiment of the present disclosure, it is possible to reduce a dielectric loss when a signal wave is transmitted between a feed line and an antenna element via a slot. This improves a gain of an antenna.

DESCRIPTION OF EMBODIMENTS

Figure 1:
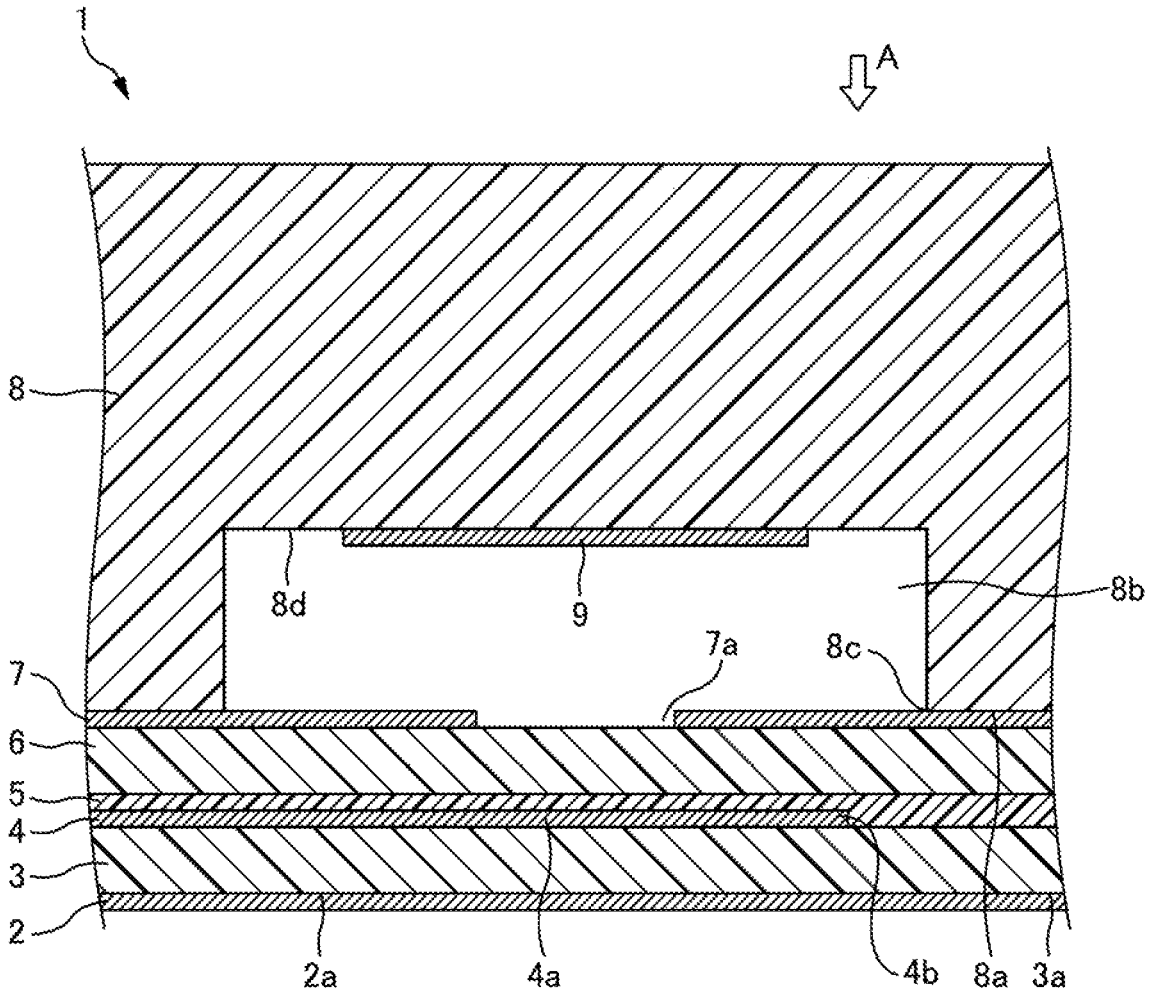
FIG. 1 is a cross-sectional view of an antenna according to a first embodiment.

At least the following matters are made apparent from the following description and the drawings.

An antenna will be made apparent which comprises: a dielectric substrate including a recess; a conductive ground layer bonded to the dielectric substrate so as to cover the recess, the conductive ground layer including a slot that is arranged on an inner side with respect to the recess; a dielectric layer bonded to the conductive ground layer on a side opposite to the dielectric substrate with respect to the conductive ground layer; an antenna element formed on a bottom of the recess at position facing the slot; and a feed line formed on a side opposite to the conductive ground layer with respect to the dielectric layer, the feed line configured to be electromagnetically coupled to the antenna element via the slot.

As described above, the conductive ground layer is bonded to the dielectric substrate so as to cover the recess, resulting in the recess being a hollow, and the hollow is interposed between the antenna element and the slot. This can reduce a dielectric loss when a signal wave is transmitted between the feed line and the antenna element via the slot, thereby improving a gain of the antenna.

The dielectric substrate is rigid.

This can allow the dielectric layer to be thin. Thus, it is possible to reduce a dielectric loss of a signal wave transmitted with the feed line, and also improve a gain of the antenna.

When the dielectric substrate is rigid, the space between the antenna element and the feed line is also less likely to change. This stabilizes radiation characteristics of the antenna.

The antenna element comprises a plurality of antenna elements, the plurality of antenna elements being aligned at intervals, the slot comprises a plurality of slots, the plurality of slots being aligned at intervals, and the antenna elements face the slots, respectively.

This can achieve improvement in gain of the antenna.

The number of the antenna elements is an even number, the number of the slots is an even number, and the feed line branches at a point between the slots adjacent to each other that are positioned in the center of a row of the slots, the feed line having branch portions that extend from the point of branch until the branch portions cross the slots at both ends of the row of the slots in plan view, respectively.

This adjusts the impedance of a portion of the feed line from each end thereof to immediately below the slot. Thus, impedance matching can be achieved between the portion of the feed line from each end thereof to immediately below the slot, the slot, and the antenna element.

The recess comprises a plurality of recesses, the antenna elements are individually formed on bottoms of the recesses, respectively, and the slots are individually arranged on an inner side with respect to the recesses, respectively.

This improves strength of the dielectric substrate by virtue of a portion between the recesses adjacent to each other, so that the dielectric substrate is less likely to be deformed. Thus, radiation characteristics of the antenna 21 are stabilized.

The slot is formed in a shape obtained by cutting out, in a rectangular shape or square shape, from both end portions of both long sides of a rectangular hole portion, in a short-side direction.

This can achieve improvement in gain of the antenna.

EMBODIMENTS

Embodiments of the present disclosure will be described below with reference to the drawings. Note that, various limitations that are technically preferable for carrying out the present disclosure are imposed on embodiments which will be described below, however, the scope of the disclosure is not to be limited to the following embodiments or illustrated examples.

First Embodiment

FIG. 1 is a cross-sectional view of an antenna 1 according to a first embodiment. The antenna 1 is used for transmitting, receiving, or both transmitting and receiving a radio wave in a frequency band of a microwave or a millimeter wave.

A dielectric layer 3 and a dielectric layer 6 are bonded to each other, using a dielectric adhesive layer 5, with a conductive pattern layer 4 sandwiched therebetween. The dielectric layer 3 and the dielectric layer 6 are made of a liquid crystal polymer.

The conductive pattern layer 4 is formed between the dielectric layer 3 and the adhesive layer 5. Note that the conductive pattern layer 4 may be formed between the dielectric layer 6 and the adhesive layer 5.

A conductive ground layer 2 is formed on a surface 3*a* of the dielectric layer 3 on a side opposite to the conductive pattern layer 4 with respect to the dielectric layer 3.

The dielectric layer 6 and a dielectric substrate 8 are bonded to each other with a conductive ground layer 7 sandwiched therebetween. The dielectric layer 6 is bonded to the conductive ground layer 7 on a side opposite to the dielectric substrate 8 with respect to the conductive ground layer 7.

The conductive ground layer 7 is formed between the dielectric layer 6 and the dielectric substrate 8.

As described above, the conductive ground layer 2, the dielectric layer 3, the conductive pattern layer 4, the adhesive layer 5, the dielectric layer 6, the conductive ground layer 7, and the dielectric substrate 8 are laminated in this order. A laminated body from the conductive ground layer 2 to the conductive ground layer 7 is flexible, and the dielectric substrate 8 is rigid. Bending deformation of the antenna 1 is less likely to occur by virtue of the rigid dielectric substrate 8 bonded to the laminated body that is from the conductive ground layer 2 to the conductive ground layer 7.

The thickness of the dielectric substrate 8 is greater than the thickness of each of the dielectric layers 3 and 6 and the adhesive layer 5, and is also greater than the total thickness of the dielectric layers 3 and 6 and the adhesive layer 5.

The conductive ground layer 2, the conductive pattern layer 4, and the conductive ground layer 7 are made of a conductive metal material such as copper.

The conductive ground layer 7 is processed and shaped by an additive method, a subtractive method, or the like, and thus a slot 7*a* is formed in the conductive ground layer 7.

The shape of the slot 7*a* may be an I shape, a rectangular shape, a round shape, or other shapes.

The conductive pattern layer 4 is processed and shaped by an additive method, a subtractive method, or the like, and thus the conductive pattern layer 4 includes a feed line 4*a*. The feed line 4*a* is formed on a side opposite to the conductive ground layer 7 with respect to the dielectric layer 6, and is formed on a side opposite to the conductive ground layer 2 with respect to the dielectric layer 3. Since the feed line 4*a* is located between the conductive ground layer 2 and the conductive ground layer 7, the feed line 4*a* constitutes a triplate or strip-line transmission line together with the conductive ground layer 2 and the conductive ground layer 7.

The feed line 4*a* crosses the slot 7*a* in plan view, and the feed line 4*a* is open at one end 4*b* thereof. Herein, the plan view refers to viewing the antenna 1 from above the antenna 1, in other words, viewing the antenna 1 in a direction of an arrow A illustrated in FIG. 1.

The impedance of a portion from the one end 4*b* to immediately below the slot 7*a* in the feed line 4*a* is adjusted according to a length from the position facing the center of the slot 7*a* to the one end 4*b* of the feed line 4*a*.

The other end portion of the feed line 4*a* is connected to a terminal of a radio frequency integrated circuit (RFIC).

A recess 8*b* is formed in a bonding surface 8*a* to be bonded to the conductive ground layer 7 out of two surfaces of the dielectric substrate 8. An opening 8*c* of the recess 8*b* faces the slot 7*a*, and the bonding surface 8*a* of the dielectric substrate 8 is bonded to the conductive ground layer 7. The opening 8*c* of the recess 8*b* is covered with the conductive ground layer 7, resulting in the recess 8*b* being a hollow. The slot 7*a* is arranged on the inner side with respect to the edge of the opening 8*c* of the recess 8*b*. A bottom 8*d* of the recess 8*b* faces the conductive ground layer 7. The depth of the recess 8*b*, in other words, the height of the hollow is greater than the thickness of each of the dielectric layers 3 and 6 and the adhesive layer 5.

A patch antenna element 9 is formed on the bottom 8*d* of the recess 8*b*. The antenna element 9 faces the slot 7*a*. The antenna element 9 is configured to be electromagnetically coupled to the feed line 4*a* through the slot 7*a*. Therefore, when the RFIC is a transmitter or a transceiver, a signal wave transmitted from the RFIC with the feed line 4*a* is transmitted to the antenna element 9 through the slot 7*a*, and an electromagnetic wave generated with the signal wave is radiated from the antenna element 9. When the RFIC is a receiver or a transceiver, a signal wave generated with an electromagnetic wave being incident on the antenna element 9 is transmitted to the feed line 4*a* through the slot 7*a*, and the signal wave is transmitted to the RFIC with the feed line 4*a*.

Herein, since the feed line 4*a* crosses the slot 7*a* in plan view, impedance matching is achieved among the portion from the one end 4*b* to immediately below the slot 7*a* in the feed line 4*a*, the slot 7*a*, and the antenna element 9.

According to an embodiment according to the present disclosure as described above, the rigid dielectric substrate reduces bending of the laminated body that is from the conductive ground layer 2 to the conductive ground layer 7. Thus, reduction in thickness of the dielectric layers 3 and 6 and the adhesive layer 5 can be achieved. The reduction in thickness of the dielectric layers 3 and 6 and the adhesive layer 5 contributes to reduction in dielectric loss and improvement in radiation efficiency. Accordingly, a gain of the antenna 1 is high, and an applicable frequency band of the antenna 1 is wide.

The hollow formed with the recess 8*b* is present between the antenna element 9 and the slot 7*a*. A dielectric loss tangent in the hollow is substantially zero when the hollow is under an atmosphere of the air. Thus, a signal wave is not affected by a dielectric when the signal wave is transmitted between the antenna element 9 and the slot 7*a*, thereby being able to reduce occurrence of a dielectric loss. Accordingly, a gain of the antenna 1 is high, and an applicable frequency band of the antenna 1 is wide.

Since the recess 8*b* is formed in the rigid dielectric substrate 8, the depth of the recess 8*b* (i.e., the height of the hollow) is less likely to change. Furthermore, a space between the antenna element 9 and the feed line 4*a* is also less likely to change. Thus, radiation characteristics of the antenna 1 are stabilized.

Since the conductive ground layer 7 is located between the antenna element 9 and the feed line 4*a*, radiation of an electromagnetic wave in the feed line 4*a* is less likely to affect radiation in the antenna element 9.

Figure 2:
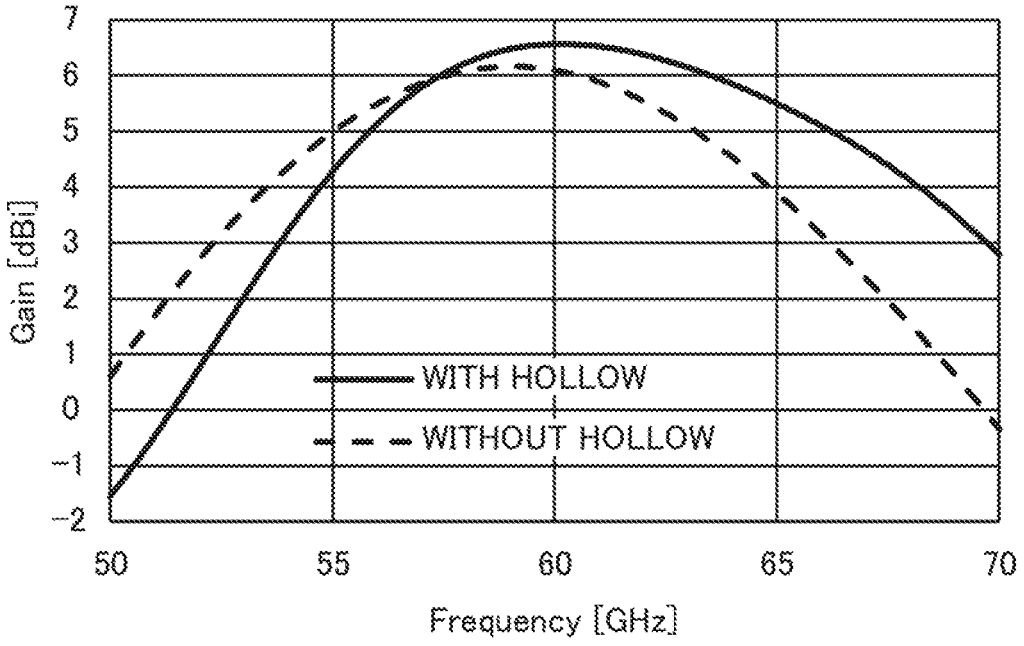
FIG. 2 is a graph illustrating a simulation result of a gain of an antenna according to a first embodiment and a gain of an antenna according to a comparative example.
Figure 3:
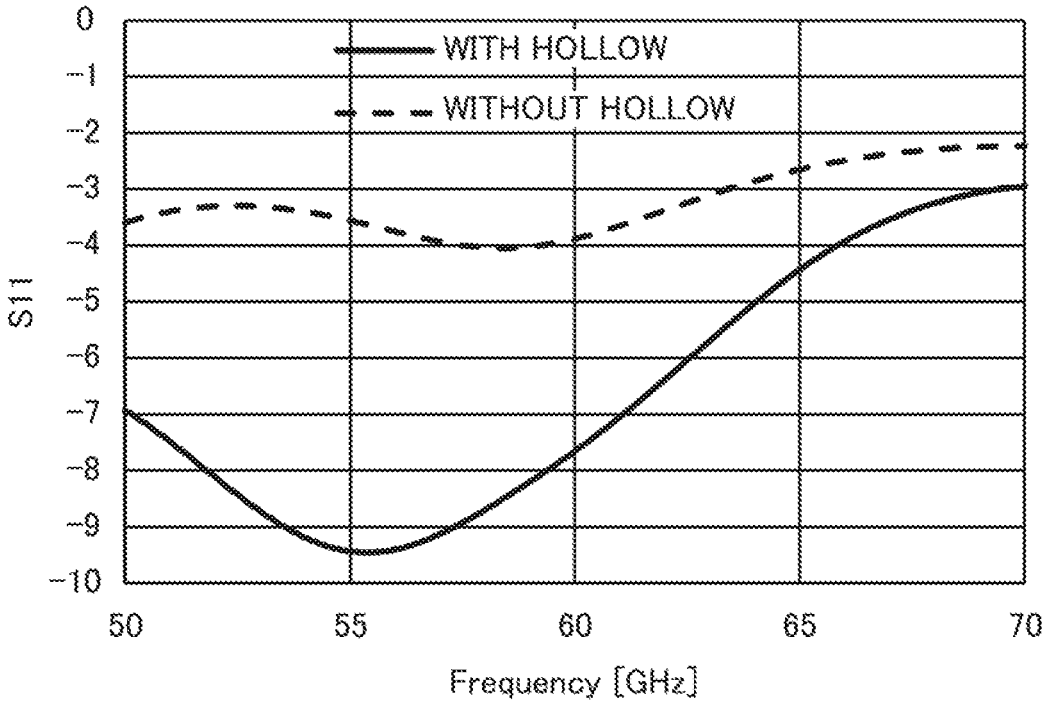
FIG. 3 is a graph illustrating a simulation result of a reflection coefficient of an antenna according to a first embodiment and a reflection coefficient of an antenna according to a comparative example.
Figure 4:
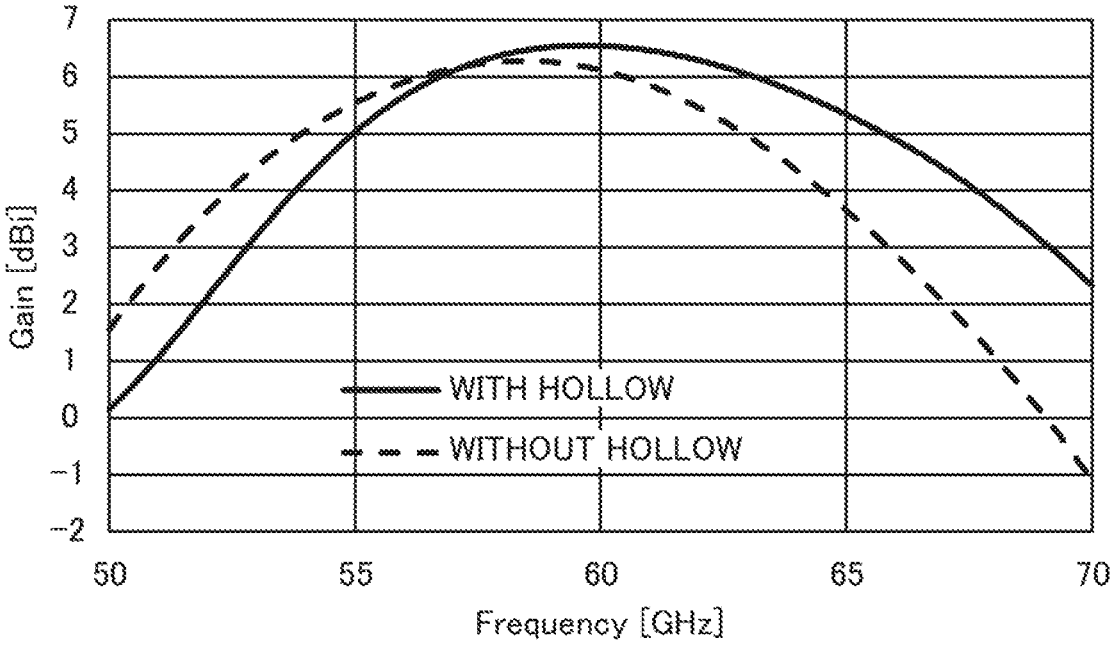
FIG. 4 is a graph illustrating a simulation result of a gain of an antenna according to a first embodiment and a gain of an antenna according to a comparative example.
Figure 5:
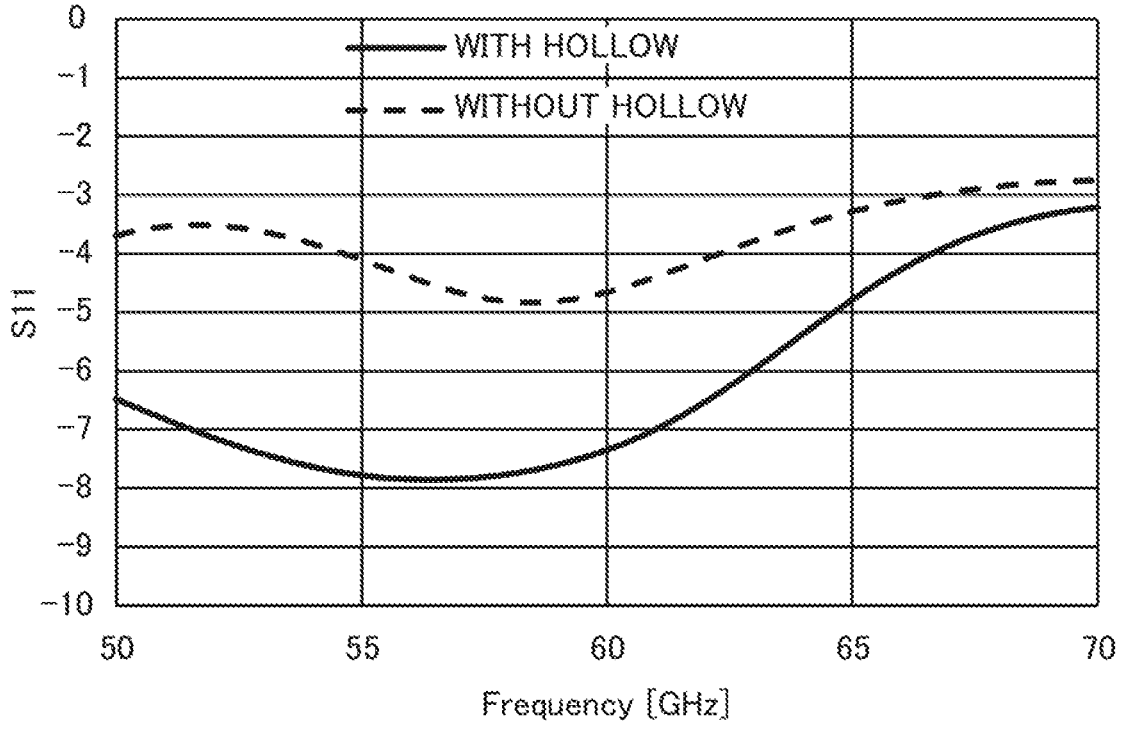
FIG. 5 is a graph illustrating a simulation result of a reflection coefficient of an antenna according to a first embodiment and a reflection coefficient of an antenna according to a comparative example.
Figure 6:
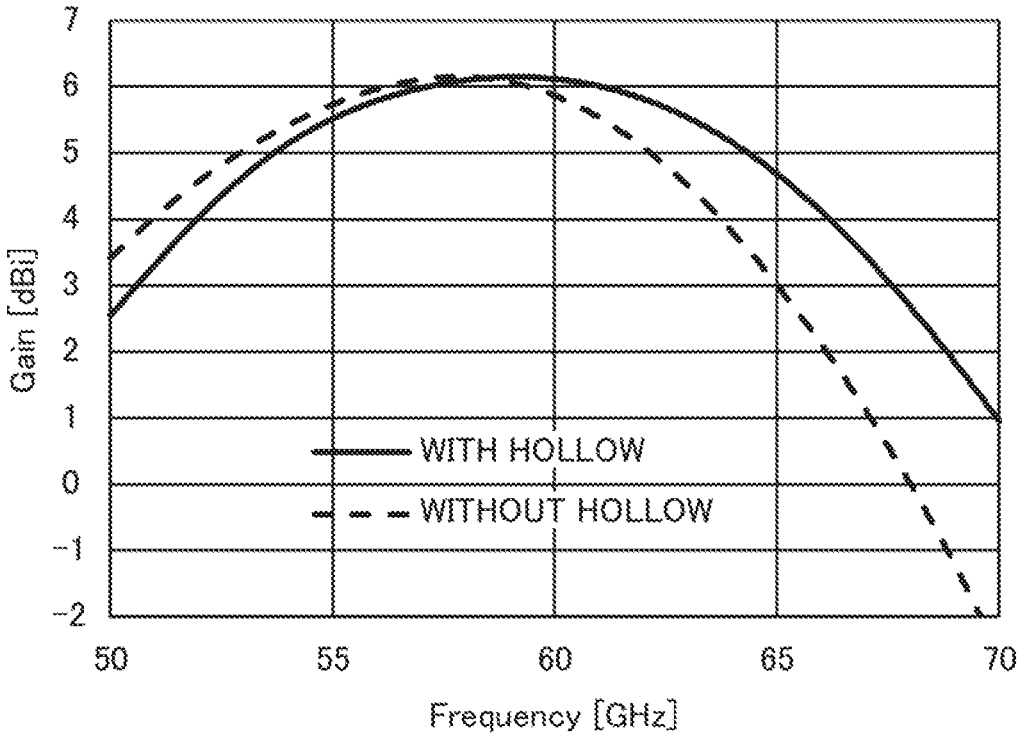
FIG. 6 is a graph illustrating a simulation result of a gain of an antenna according to a first embodiment and a gain of an antenna according to a comparative example.
Figure 7:
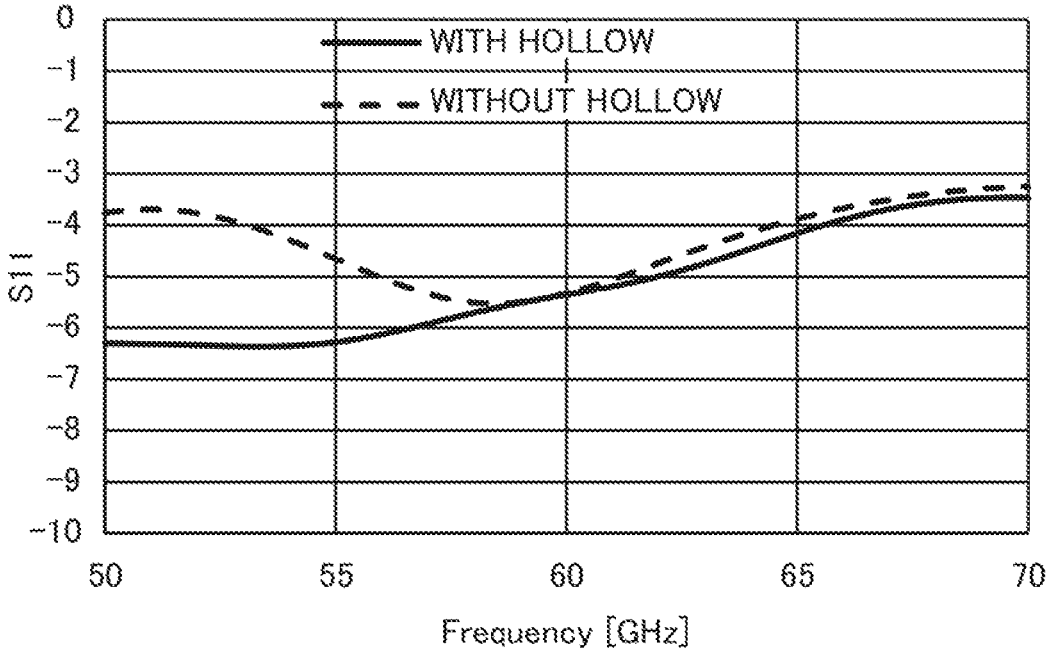
FIG. 7 is a graph illustrating a simulation result of a reflection coefficient of an antenna according to a first embodiment and a reflection coefficient of an antenna according to a comparative example.
Figure 8:
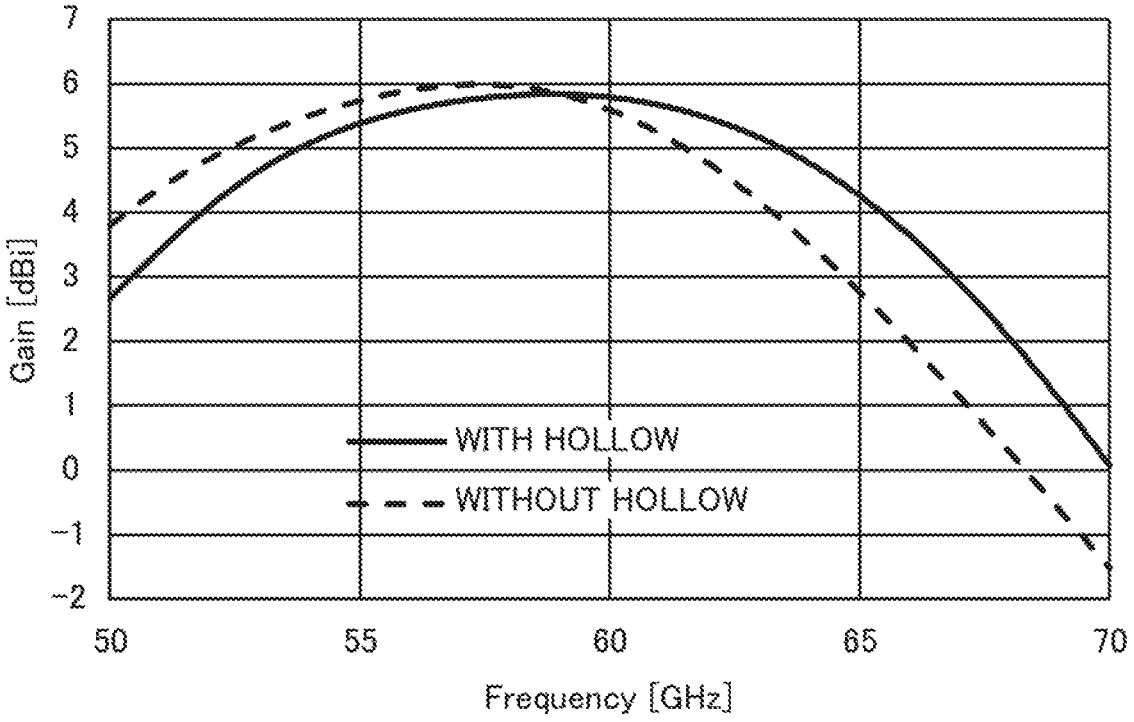
FIG. 8 is a graph illustrating a simulation result of a gain of an antenna according to a first embodiment and a gain of an antenna according to a comparative example.
Figure 9:
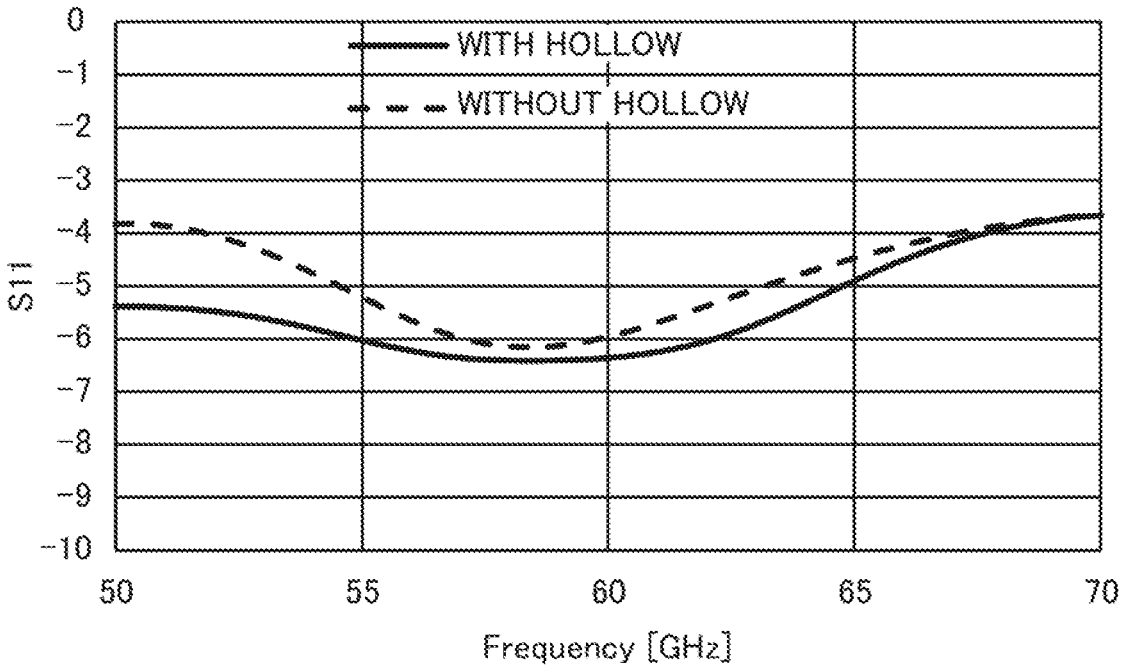
FIG. 9 is a graph illustrating a simulation result of a reflection coefficient of an antenna according to a first embodiment and a reflection coefficient of an antenna according to a comparative example.

A contribution of the hollow existing between the antenna element 9 and the slot 7*a* to improvement in radiation characteristics of the antenna 1 has been verified by simulations. A simulation result when the depth of the recess 8*b*, in other words, the height of the hollow is 0.25 mm is illustrated in FIGS. 2 and 3. A simulation result when the height of the hollow is 0.3 mm is illustrated in FIGS. 4 and 5. A simulation result when the height of the hollow is 0.35 mm is illustrated in FIGS. 6 and 7. A simulation result when the height of the hollow is 0.4 mm is illustrated in FIGS. 8 and 9. The vertical axis represents a gain, and the horizontal axis represents a frequency in each graph in FIGS. 2, 4, 6, and 8. The vertical axis represents S11 of S-parameters, and the horizontal axis represents a frequency in each graph in FIGS. 3, 5, 7, and 9. S11 refers to a reflection coefficient in a connecting section between the feed line 4*a* and the terminal of the RFIC. In all of FIGS. 2 to 9, a solid line indicates a result using the antenna 1 as a simulation target. A broken line indicates a result using, as a simulation target, an antenna without a hollow obtained by filling the recess 8*b* with a liquid crystal polymer that is a dielectric.

As is apparent from FIGS. 2, 4, 6, and 8, it is found that when gains in a use band of 57 to 67 GHz are averaged, the average gain of the antenna 1 with the hollow is higher than the average gain of the antenna without the hollow. In particular, in the use band of 57 to 67 GHz, a band in which the gain of the antenna 1 with the hollow is higher than the gain of the antenna without the hollow is wider than a band in which the gain of the antenna 1 with the hollow is lower than the gain of the antenna without the hollow.

As is apparent from FIGS. 3, 5, 7, and 9, it is found that the reflection coefficient of the antenna 1 with the hollow is lower than the reflection coefficient of the antenna without the hollow in the use band of 57 to 67 GHz.

From the foregoing simulation results, it is found that the hollow existing between the antenna element 9 and the slot 7*a* contributes to improvement in radiation characteristics of the antenna 1.

Second Embodiment

Figure 10:
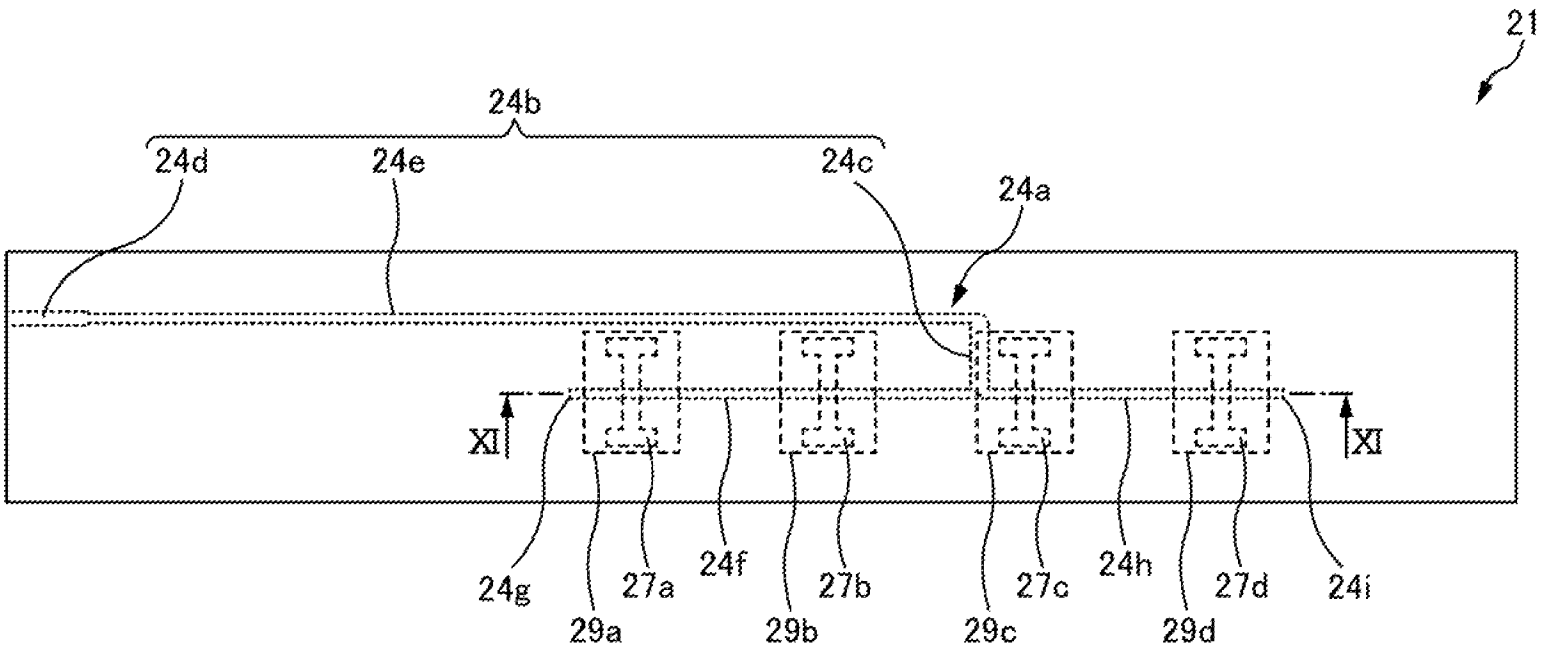
FIG. 10 is a plan view of an antenna according to a second embodiment.
Figure 11:
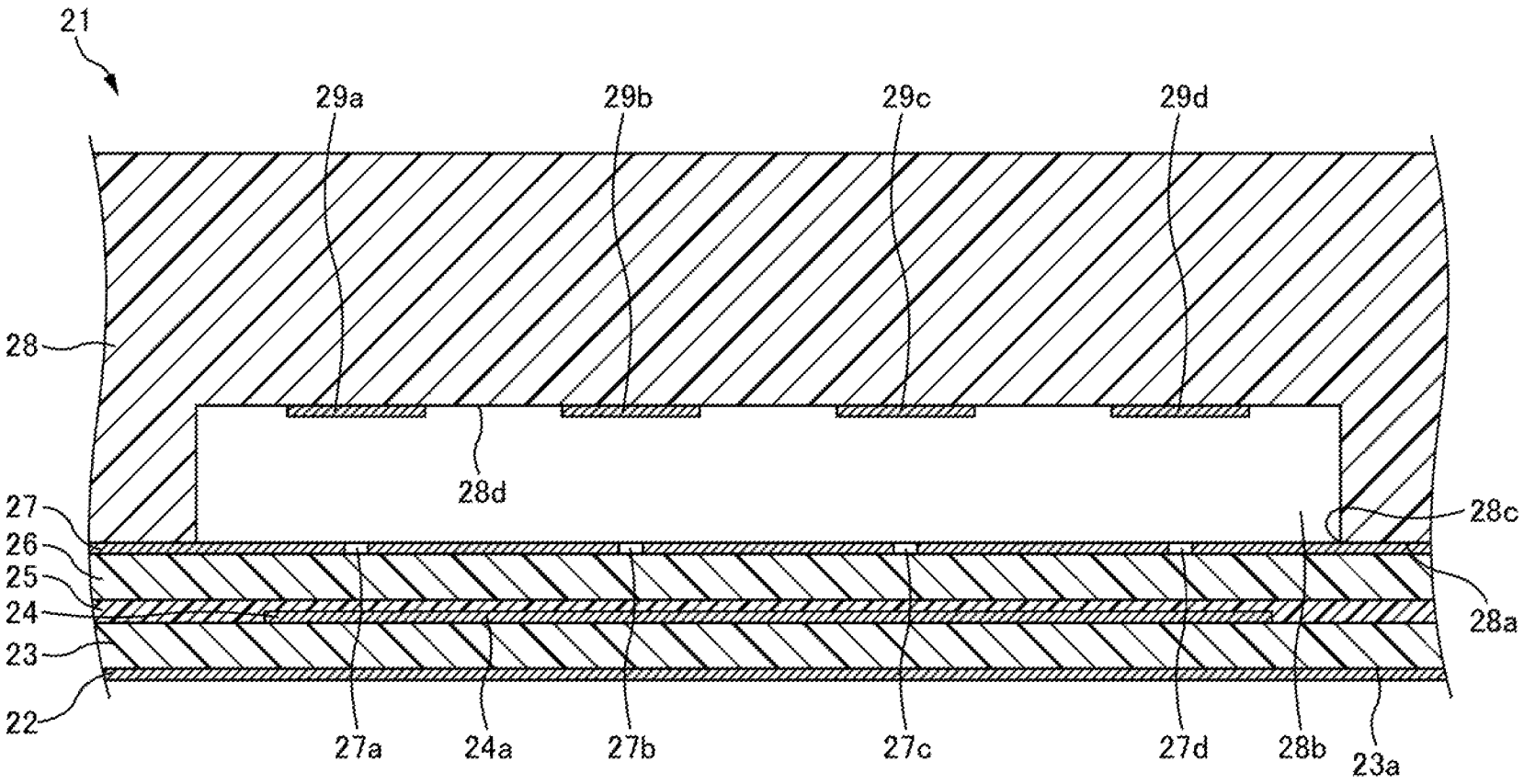
FIG. 11 is a cross-sectional view illustrating taken along XI-XI in FIG. 10.

FIG. 10 is a schematic plan view of an antenna 21 according to a second embodiment. FIG. 11 is a cross-sectional view taken along XI-XI in FIG. 10.

The antenna 21 is used for transmitting, receiving, or both transmitting and receiving a radio wave in a frequency band of a microwave or a millimeter wave.

A dielectric layer 23 and a dielectric layer 26 sandwich a conductive pattern layer 24 therebetween, and are bonded to each other using a dielectric adhesive layer 25. The dielectric layer 23 and the dielectric layer 26 are made of a liquid crystal polymer.

The conductive pattern layer 24 is formed between the dielectric layer 23 and the adhesive layer 25. Note that the conductive pattern layer 24 may be formed between the dielectric layer 26 and the adhesive layer 25.

A conductive ground layer 22 is formed on a surface 23*a* of the dielectric layer 23 on a side opposite to the conductive pattern layer 24 with respect to the dielectric layer 23.

The dielectric layer 26 and a dielectric substrate 28 sandwich a conductive ground layer 27 therebetween, and are bonded to each other. The dielectric layer 26 is bonded to the conductive ground layer 27 on a side opposite to the dielectric substrate 28 with respect to the conductive ground layer 27.

The conductive ground layer 27 is formed between the dielectric layer 26 and the dielectric substrate 28.

As described above, the conductive ground layer 22, the dielectric layer 23, the conductive pattern layer 24, the adhesive layer 25, the dielectric layer 26, the conductive ground layer 27, and the dielectric substrate 28 are laminated in this order. A laminated body from the conductive ground layer 22 to the conductive ground layer 27 is flexible, and the dielectric substrate 28 is rigid. Bending deformation of the antenna 21 is less likely to occur by virtue of the dielectric substrate 28 being bonded to the laminated body that is from the conductive ground layer 22 to the conductive ground layer 27.

The thickness of the dielectric substrate 28 is greater than the thickness of each of the dielectric layers 23 and 26 and the adhesive layer 25, and is also greater than the total thickness of the dielectric layers 23 and 26 and the adhesive layer 25.

The conductive ground layer 22, the conductive pattern layer 24, and the conductive ground layer 27 are made of a conductive metal material such as copper.

The conductive ground layer 27 is processed and shaped by an additive method, a subtractive method, or the like, and thus a plurality of slots 27*a* to 27*d* are formed in the conductive ground layer 27. The slots 27*a* to 27*d* are aligned at regular intervals in a short-side direction of the slots 27*a* to 27*d*.

Figure 12:
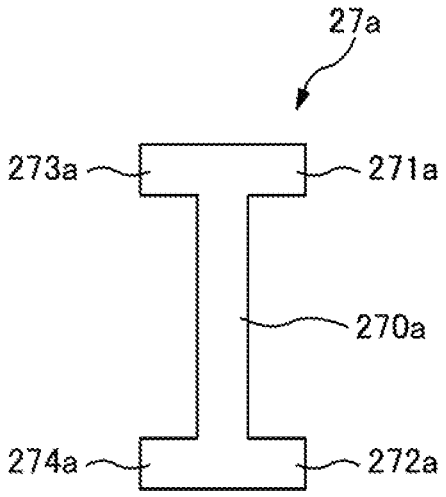
FIG. 12 is a plan view of a slot.
Figure 13:
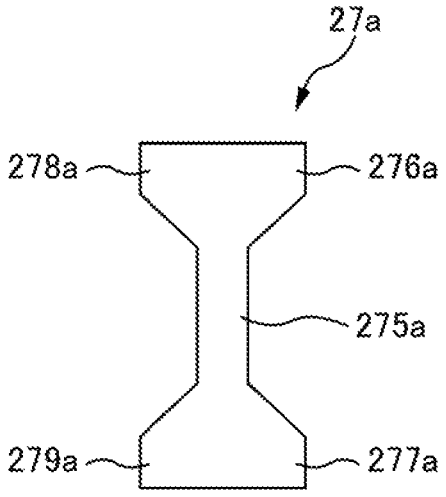
FIG. 13 is a plan view of a slot.

The slot 27*a* is formed in an I shape as illustrated in FIG. 12 or 13.

In a case of FIG. 12, the slot 27*a* is formed in a shape obtained by cutting out, in a rectangular shape or square shape, from both end portions of one of long sides of a rectangular hole portion 270*a*, in the short-side direction (see reference signs 271*a* and 272*a*), and cutting out, in a rectangular shape or square shape, from both end portions of the other long side of the hole portion 270*a*, in the short-side direction (see reference signs 273*a* and 274*a*).

In a case of FIG. 13, the slot 27*a* is formed in a shape obtained by cutting out, in a trapezoidal shape, from both end portions of one of long sides of a rectangular hole portion 275*a*, in the short-side direction (see reference signs 276*a* and 277*a*), and cutting out, in a trapezoidal shape, from both end portions of the other long side of the hole portion 275*a*, in the short-side direction (see reference signs 278*a* and 279*a*). The portions 276*a* and 277*a* obtained by being cut into the trapezoidal shape are tapered, and the widths of the portions 276*a* and 277*a* obtained by being cut into the trapezoidal shape gradually decreases as a distance from one of the long sides of the hole portion 275*a* increases. The portions 278*a* and 279*a* obtained by being cut into the trapezoidal shape are tapered, and the widths of the portions 278*a* and 279*a* obtained by being cut into the trapezoidal shape gradually decreases as a distance from the other long side of the hole portion 275*a* increases.

The shape and size of the slots 27*b* to 27*d* are the same as those of the slot 27*a*.

Note that the shape of the slots 27*a* to 27*d* is not limited to the I shape, but may be a rectangular shape, a round shape, or other shapes.

The conductive pattern layer 24 is processed and shaped by an additive method, a subtractive method, or the like, and thus the conductive pattern layer 24 includes a feed line 24*a*. The feed line 24*a* is formed on a side opposite to the conductive ground layer 27 with respect to the dielectric layer 26, and is formed on a side opposite to the conductive ground layer 22 with respect to the dielectric layer 23. Since the feed line 24*a* is located between the conductive ground layer 22 and the conductive ground layer 27, the feed line 24*a* constitutes a triplate or strip-line transmission line together with the conductive ground layer 22 and the conductive ground layer 27.

The feed line 24*a* is a T-shaped line having branches. The feed line 24*a* includes a main line portion 24*b* and branch line portions 24*f* and 24*h*.

The main line portion 24*b* is formed in an L shape.

The branch line portions 24*f* and 24*h* are formed by branching from one end portion 24*c* of the main line portion 24*b* at the position between the slots 27*b* and 27*c* adjacent to each other in the center of a row of the slots 27*a* to 27*d*. The branch line portions 24*f* and 24*h* extend linearly in directions opposite to each other from a branch point. A direction in which the branch line portions 24*f* and 24*h* extend is parallel to a direction in which the slots 27*a* to 27*d* are aligned.

The other end portion 24*d* of the main line portion 24*b* is connected to a terminal of an RFIC.

The width of the one end portion 24*c* and the other end portion 24*d* of the main line portion 24*b* are wider than the width of a portion 24*e* between the one end portion 24*c* and the other end portion 24*d*. Thus, the impedance of the one end portion 24*c* and the other end portion 24*d* of the main line portion 24*b* is smaller than the impedance of the portion 24*e* between the one end portion 24*c* and the other end portion 24*d*. For example, the impedance of the one end portion 24*c* and the other end portion 24*d* of the main line portion 24*b* is a half of the impedance of the portion 24*e* between the one end portion 24*c* and the other end portion 24*d*.

The width of the branch line portions 24*f* and 24*h* is smaller than the width of the one end portion 24*c* and the other end portion 24*d* of the main line portion 24*b*, and is equal to the width of the portion 24*e* between the one end portion 24*c* and the other end portion 24*d*. Thus, the impedance of the branch line portions 24*f* and 24*h* is greater than the impedance of the one end portion 24*c* and the other end portion 24*d* of the main line portion 24*b*. For example, the impedance of the branch line portions 24*f* and 24*h* is twice the impedance of the one end portion 24*c* and the other end portion 24*d* of the main line portion 24*b*.

The branch line portion 24*f* extends from the branch point and crosses the slots 27*b* and 27*a* in plan view, and the branch line portion 24*f* is open at one end 24*g* thereof. The impedance of a portion from the one end 24*g* to immediately below the slot 27*a* in the branch line portion 24*f* is adjusted according to a length from the position facing the center of the slot 27*a* to the one end 24*g* of the branch line portion 24*f*.

The branch line portion 24*h* extends from the branch point and crosses the slots 27*c* and 27*d* in plan view, and the branch line portion 24*h* is open at one end 24*i* thereof. The impedance of a portion from the one end 24*i* to immediately below the slot 27*d* in the branch line portion 24*h* is adjusted according to a length from the position facing the center of the slot 27*d* to the one end 24*i* of the branch line portion 24*h*.

The electrical length of the portion from the branch point to immediately below the slot 27*b* is different from the electrical length of the portion from the branch point to immediately below the slot 27*c* in the feed line 24*a*. Specifically, a difference between the electrical length of the portion from the branch point to immediately below the slot 27*b* and the electrical length of the portion from the branch point to immediately below the slot 27*c* in the feed line 24*a* is equal to a quarter of the effective wavelength in the center of a band to be used. This improves a gain of the antenna 1. Note that a difference between the electrical length of the portion from the branch point to immediately below the slot 27*b* and the electrical length of the portion from the branch point to immediately below the slot 27*c* in the feed line 24*a* may be equal to a half of an effective wavelength in the center of a band to be used. The electrical length of the portion from the branch point to immediately below the slot 27*b* in the feed line 24*a* may be equal to the electrical length of the portion from the branch point to immediately below the slot 27*c* in the feed line 24*a*.

A recess 28*b* is formed in a bonding surface 28*a* to be bonded to the conductive ground layer 27 out of two surfaces of the dielectric substrate 28. An opening 28*c* of the recess 28*b* faces the slots 27*a* to 27*d*, and the bonding surface 28*a* of the dielectric substrate 28 is bonded to the conductive ground layer 27. The opening 28*c* of the recess 28*b* is covered with the conductive ground layer 27, resulting in the recess 28*b* being a hollow. The slots 27*a* to 27*d* are arranged on the inner side with respect to the edge of the opening 28*c* of the recess 28*b*. A bottom 28*d* of the recess 28*b* faces the conductive ground layer 27. A bottom 28*d* of the recess 28*b* is flat, and is parallel to the conductive ground layer 27. The depth of the recess 28*b*, in other words, the height of the hollow is greater than the thickness of each of the dielectric layers 23 and 26 and the adhesive layer 25.

Patch antenna elements 29*a* to 29*d* are formed on the bottom 28*d* of the recess 28*b*. The antenna elements 29*a* to 29*d* are aligned at regular intervals in a direction parallel to a direction in which the slots 27*a* to 27*d* are aligned. The antenna element 29*a* faces the slot 27*a*, the antenna element 29*b* faces the slot 27*b*, the antenna element 29*c* faces the slot 27*c*, and the antenna element 29*d* faces the slot 27*d*. The antenna element 29*a* is configured to be electromagnetically coupled to the branch line portion 24*f* of the feed line 24*a* through the slot 27*a*. The antenna element 29*b* is configured to be electromagnetically coupled to the branch line portion 24*f* of the feed line 24*a* through the slot 27*b*. The antenna element 29*c* is configured to be electromagnetically coupled to the branch line portion 24*h* of the feed line 24*a* through the slot 27*c*. The antenna element 29*d* is configured to be electromagnetically coupled to the branch line portion 24*h* of the feed line 24*a* through the slot 27*d*. Accordingly, when the RFIC is a transmitter or a transceiver, a signal wave transmitted from the RFIC using the feed line 24*a* is transmitted to the antenna elements 29*a* to 29*d* through the slots 27*a* to 27*d*, respectively, and electromagnetic waves generated with the signal waves are radiated from the antenna elements 29*a* to 29*d*. When the RFIC is a receiver or a transceiver, signal waves generated with electromagnetic waves being incident on the antenna elements 29*a* to 29*d* are transmitted to the feed line 24*a* through the slots 27*a* to 27*d*, and the signal waves are transmitted to the RFIC using the feed line 24*a*.

Herein, since the branch line portion 24*f* of the feed line 24*a* crosses the slot 27*a* in plan view, impedance matching is achieved among the portion from the one end 24*g* to immediately below the slot 27*a* in the branch line portion 24*f*, the slot 27*a*, and the antenna element 29*a*. Since the branch line portion 24*h* of the feed line 24*a* crosses the slot 27*d* in plan view, impedance matching is achieved among the portion from the one end 24*i* to immediately below the slot 27*d* in the branch line portion 24*h*, the slot 27*d*, and the antenna element 29*d*.

According to an embodiment according to the present disclosure described above, the rigid dielectric substrate 28 reduces bending of the laminated body that is from the conductive ground layer 22 to the conductive ground layer 27. This can achieve reduction in thickness of the dielectric layers 23 and 26 and the adhesive layer 25. The reduction in thickness of the dielectric layers 23 and 26 and the adhesive layer 25 contributes to reduction in dielectric loss and improvement in radiation efficiency. Accordingly, a gain of the antenna 21 is high, and an applicable frequency band of the antenna 21 is wide.

The hollow formed with the recess 28*b* is present between the antenna elements 29*a* to 29*d* and the slots 27*a* to 27*d*. A dielectric loss tangent in the hollow is substantially zero when the hollow is under an atmosphere of the air. Thus, a signal wave is not affected by a dielectric when the signal waves are transmitted between the antenna elements 29*a* to 29*d* and the slots 27*a* to 27*d*, thereby being able to reduce occurrence of a dielectric loss. Accordingly, a gain of the antenna 21 is high, and an applicable frequency band of the antenna 21 is wide.

Since the recess 28*b* is formed in the rigid dielectric substrate 28, the depth of the recess 28*b* (i.e., the height of the hollow) is less likely to change. Furthermore, a space between the antenna elements 29*a* to 29*d* and the feed line 24*a* is also less likely to change. Thus, radiation characteristics of the antenna 21 are stabilized.

Since the conductive ground layer 27 is located between the antenna elements 29*a* to 29*d* and the feed line 24*a*, radiation of electromagnetic waves in the feed line 24*a* is less likely to affect radiation in the antenna elements 29*a* to 29*d*.

Figure 14:
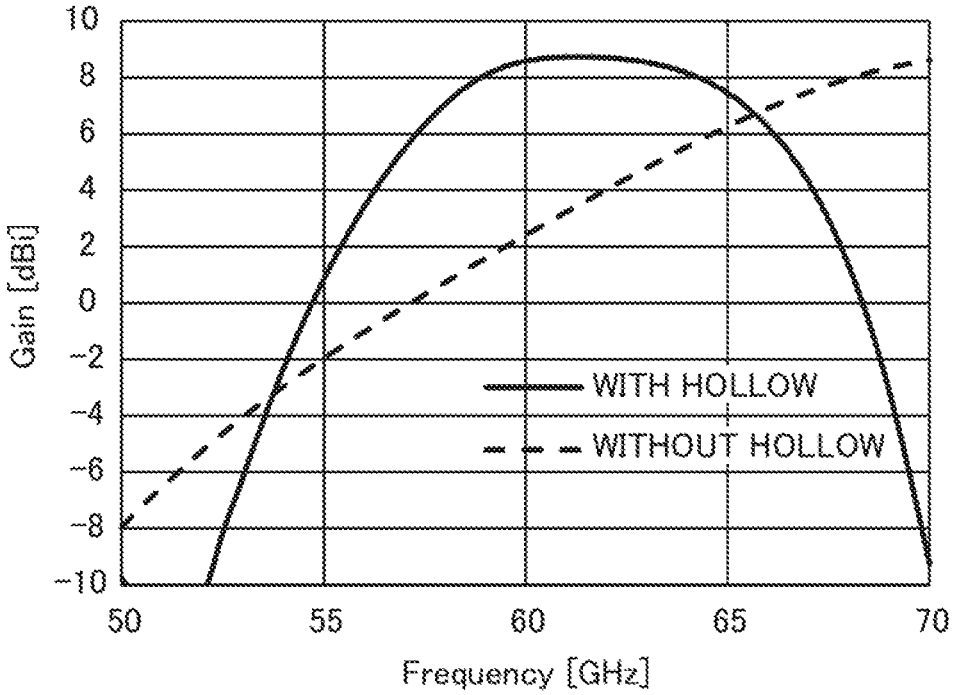
FIG. 14 is a graph illustrating a simulation result of a gain of an antenna according to a second embodiment and a gain of an antenna according to a comparative example.
Figure 15:
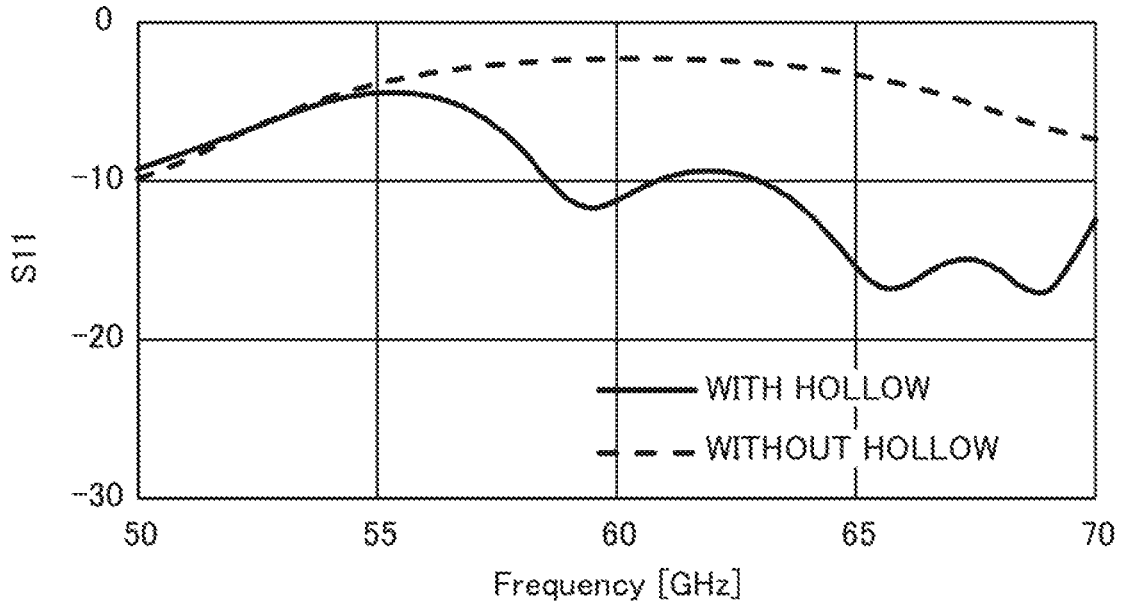
FIG. 15 is a graph illustrating a simulation result of a reflection coefficient of an antenna according to a second embodiment and a reflection coefficient of an antenna according to a comparative example.
Figure 16:
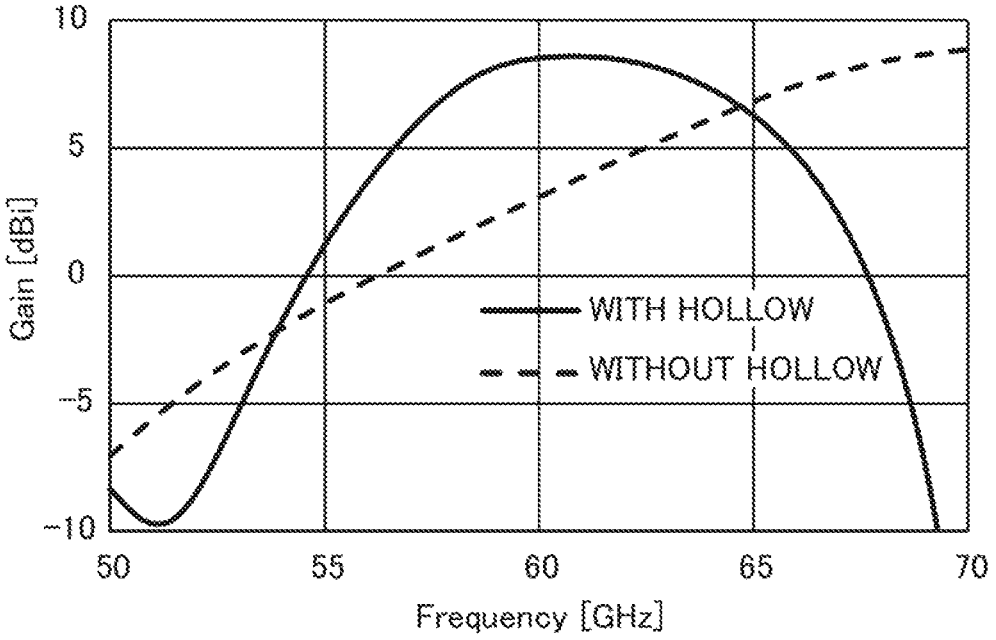
FIG. 16 is a graph illustrating a simulation result of a gain of an antenna according to a second embodiment and a gain of an antenna according to a comparative example.
Figure 17:
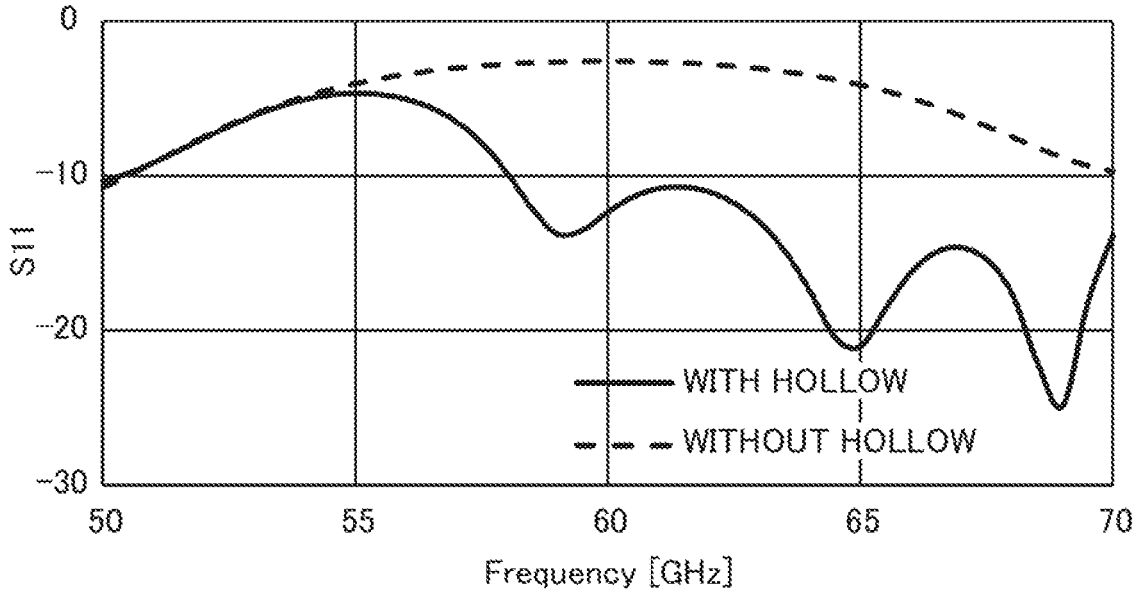
FIG. 17 is a graph illustrating a simulation result of a reflection coefficient of an antenna according to a second embodiment and a reflection coefficient of an antenna according to a comparative example.
Figure 18:
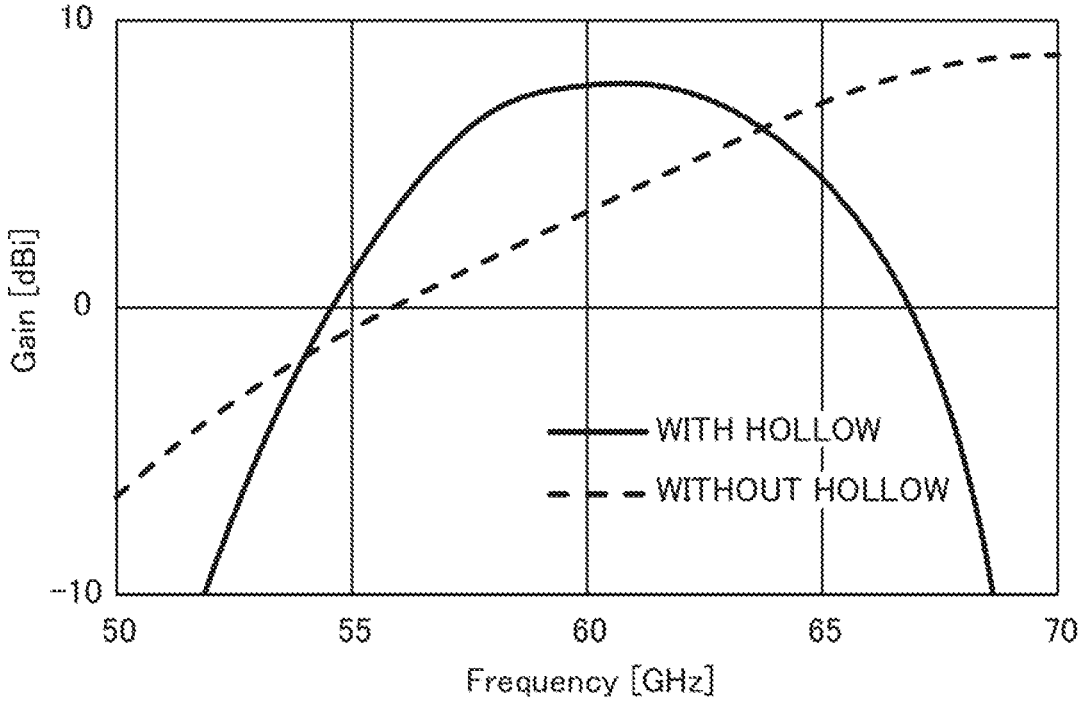
FIG. 18 is a graph illustrating a simulation result of a gain of an antenna according to a second embodiment and a gain of an antenna according to a comparative example.
Figure 19:
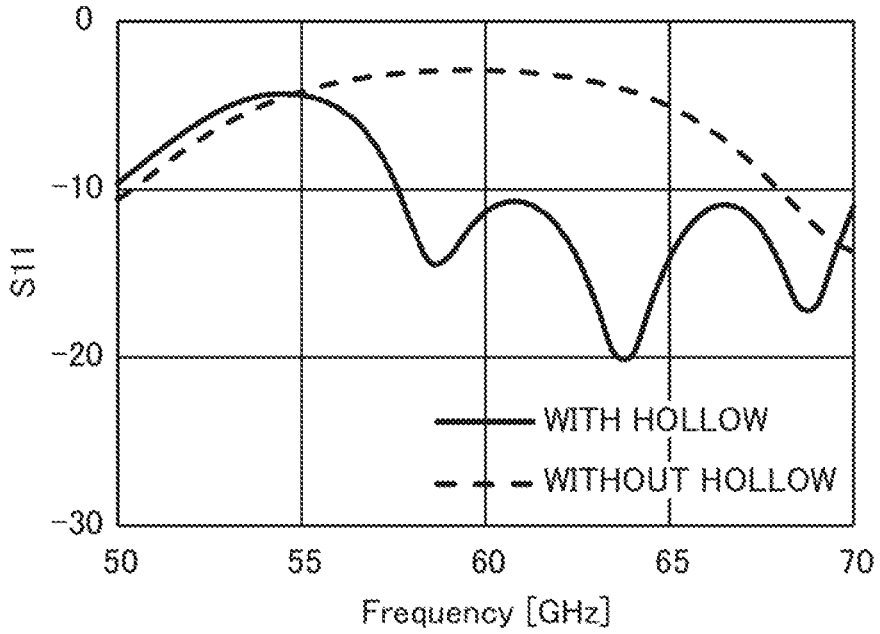
FIG. 19 is a graph illustrating a simulation result of a reflection coefficient of an antenna according to a second embodiment and a reflection coefficient of an antenna according to a comparative example.
Figure 20:
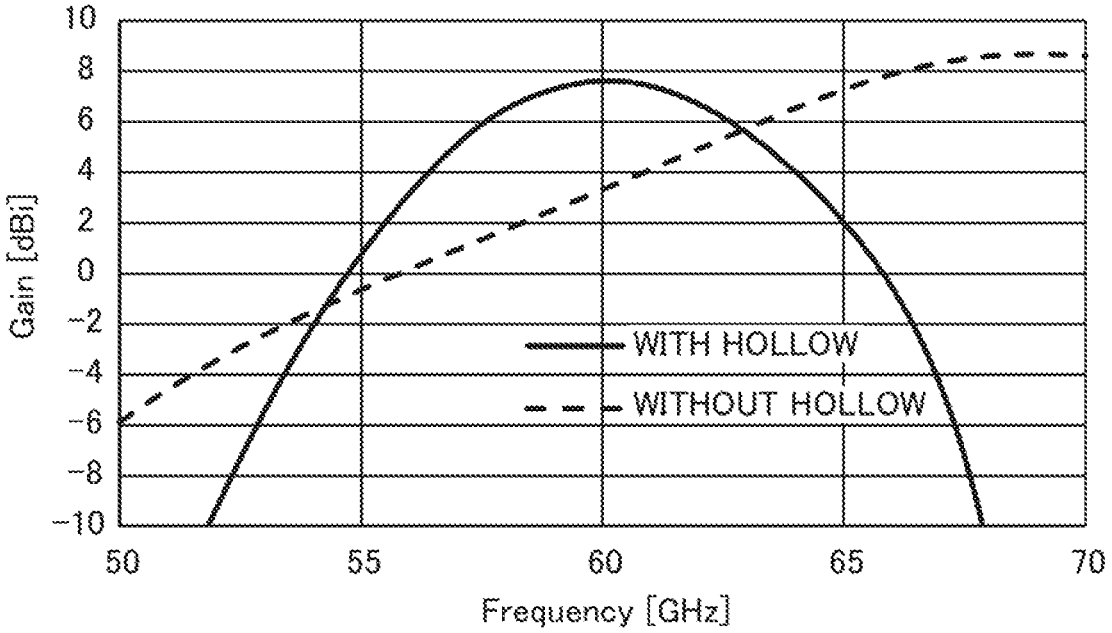
FIG. 20 is a graph illustrating a simulation result of a gain of an antenna according to a second embodiment and a gain of an antenna according to a comparative example.
Figure 21:
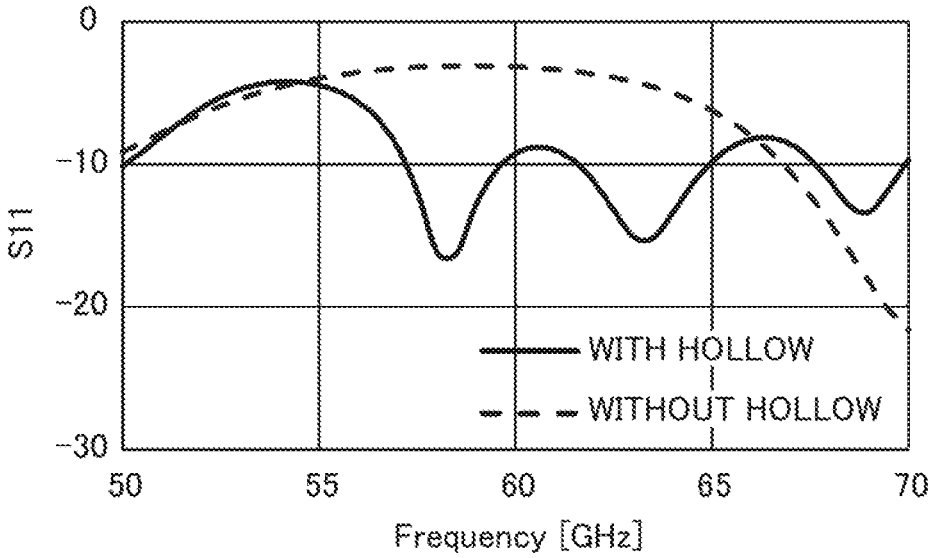
FIG. 21 is a graph illustrating a simulation result of a reflection coefficient of an antenna according to a second embodiment and a reflection coefficient of an antenna according to a comparative example.

When the slots 27*a* to 27*d* have the shape illustrated in FIG. 12, a contribution of the hollow existing between the antenna elements 29*a* to 29*d* and the slots 27*a* to 27*d* to improvement in gain of the antenna 21 has been verified by simulations. A simulation result when the depth of the recess 28*b*, in other words, the height of the hollow is 0.25 mm is illustrated in FIGS. 14 and 15. A simulation result when the height of the hollow is 0.3 mm is illustrated in FIGS. 16 and 17. A simulation result when the height of the hollow is 0.35 mm is illustrated in FIGS. 18 and 19. A simulation result when the height of the hollow is 0.4 mm is illustrated in FIGS. 20 and 21. The vertical axis represents a gain, and the horizontal axis represents a frequency in each graph in FIGS. 14, 16, 18, and 20. The vertical axis represents S11 of S-parameters, and the horizontal axis represents a frequency in each graph in FIGS. 15, 17, 19, and 21. S11 refers to a reflection coefficient in a connecting section between the feed line 24*a* and the terminal of the RFIC. In all of FIGS. 14 to 21, a solid line indicates a result using the antenna 21 as a simulation target. A broken line indicates a result using, as a simulation target, an antenna without a hollow obtained by filling the recess 28*b* with a liquid crystal polymer that is a dielectric.

As is apparent from FIGS. 14, 16, 18, and 20, it is found that a gain of the antenna 21 with the hollow takes a local maximum value in a use band of 57 to 67 GHz, whereas a gain of the antenna without the hollow does not take a local maximum value in the use band of 57 to 67 GHz. It is also found that the gain of the antenna 21 with the hollow is higher than the gain of the antenna without the hollow.

As is apparent from FIGS. 15, 17, 19, and 21, it is found that the reflection coefficient of the antenna 21 with the hollow is lower than the reflection coefficient of the antenna without the hollow, in the use band of 57 to 67 GHz.

It is found from the foregoing simulation results that the hollow existing between the antenna elements 29*a* to 29*d* and the slots 27*a* to 27*d* contributes to improvement in gain of the antenna 21.

Figure 22:
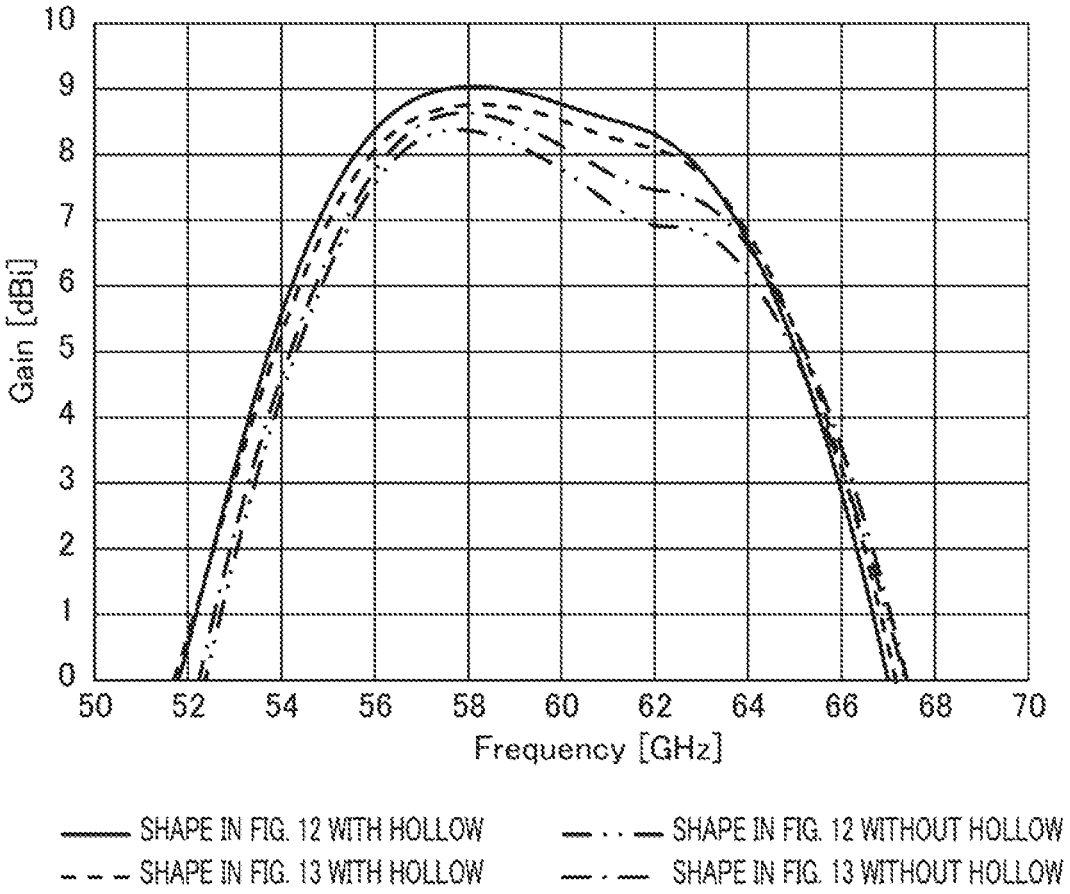
FIG. 22 is a graph illustrating a simulation result of a gain of an antenna according to a second embodiment and a gain of an antenna according to a comparative example.
Figure 23:
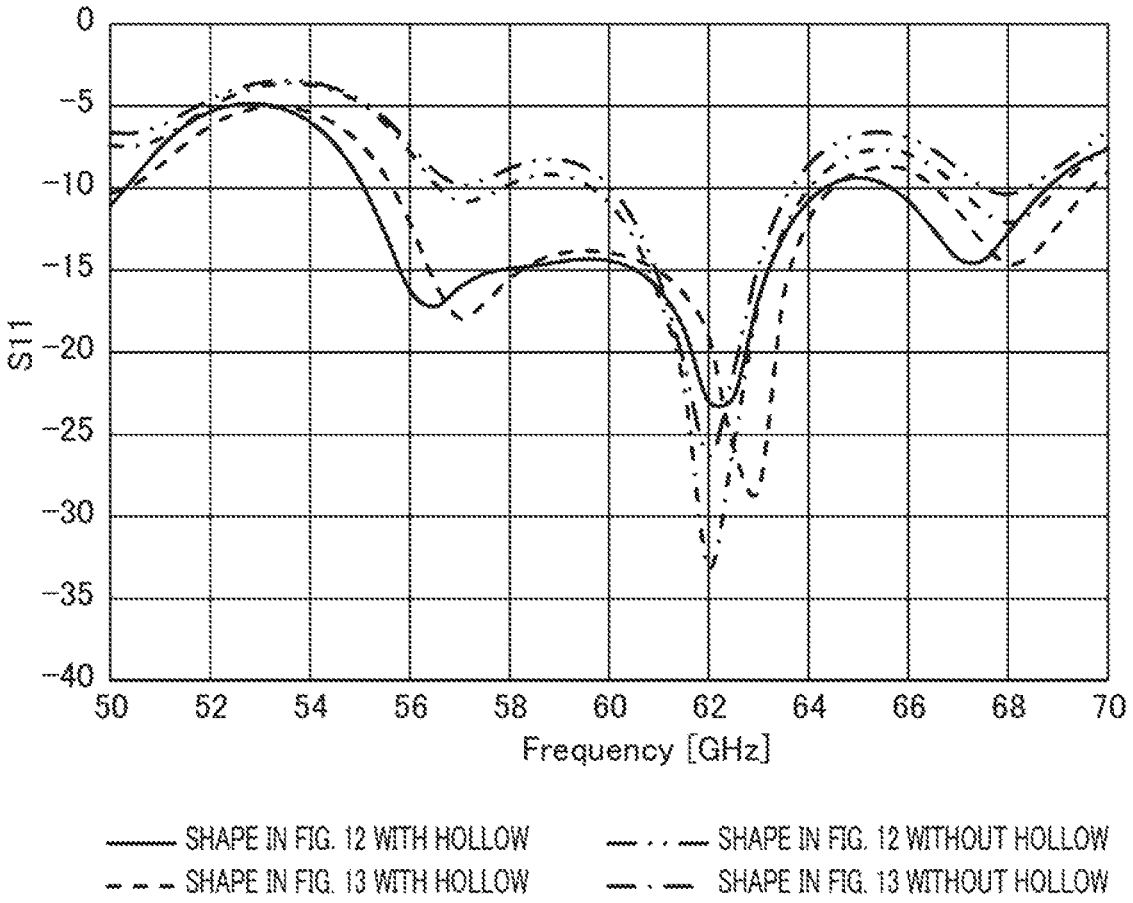
FIG. 23 is a graph illustrating a simulation result of a reflection coefficient of an antenna according to a second embodiment and a reflection coefficient of an antenna according to a comparative example.

When the slots 27*a* to 27*d* have the shape illustrated in FIG. 12 or 13, a contribution of the hollow existing between the antenna elements 29*a* to 29*d* and the slots 27*a* to 27*d* to improvement in gain of the antenna 21 has been verified by simulations. A simulation result is illustrated in FIGS. 22 and 23. The vertical axis represents a gain and the horizontal axis represents a frequency, in the graph of FIG. 22. The vertical axis represents S11 of S-parameters and the horizontal axis represents a frequency, in the graph of FIG. 23. In both of FIGS. 22 and 23, a solid line indicates a result using the antenna 21 as a simulation target when the slots 27*a* to 27*d* have the shape illustrated in FIG. 12. A broken line indicates a result using the antenna 21 as a simulation target when the slots 27*a* to 27*d* have the shape illustrated in FIG. 13. A chain double-dashed line indicates a result using, as a simulation target, the antenna without the hollow obtained by filling the recess 28*b* with a liquid crystal polymer that is a dielectric, when the slots 27*a* to 27*d* have the shape illustrated in FIG. 12. An alternate long and short dashed line indicates a result using, as a simulation target, the antenna without the hollow obtained by filling the recess 28*b* with a liquid crystal polymer that is a dielectric, when the slots 27*a* to 27*d* have the shape illustrated in FIG. 13.

As is apparent from FIG. 22, it is found that even when the slots 27*a* to 27*d* have either of the shapes of FIGS. 12 and 13, a gain of the antenna 21 with the hollow (see the solid line and the broken line) is higher than a gain of the antenna without the hollow (see the chain double-dashed line and the alternate long and short dashed line), in a band of 53 to 64 GHz. It is also found that a gain of the antenna 21 (see the solid line) in which the slots 27*a* to 27*d* have the shape illustrated in FIG. 12 is higher than a gain of the antenna 21 (see the broken line) in which the slots 27*a* to 27*d* have the shape illustrated in FIG. 13, in the band of 53 to 63 GHz.

As is apparent from FIG. 23, it is found that even when the slots 27*a* to 27*d* have either of the shapes of FIGS. 12 and 13, the reflection coefficient of the antenna 21 with the hollow (see the solid line and the broken line) is lower than the reflection coefficient of the antenna without the hollow (see the chain double-dashed line and the alternate long and short dashed line) in bands of 52 to 60.5 and 63.5 to 68 GHz.

Modification Examples of Second Embodiment

Next, some modifications from the second embodiment will be described. The modifications which will be described below can be applied separately or in combination.

Figure 24:
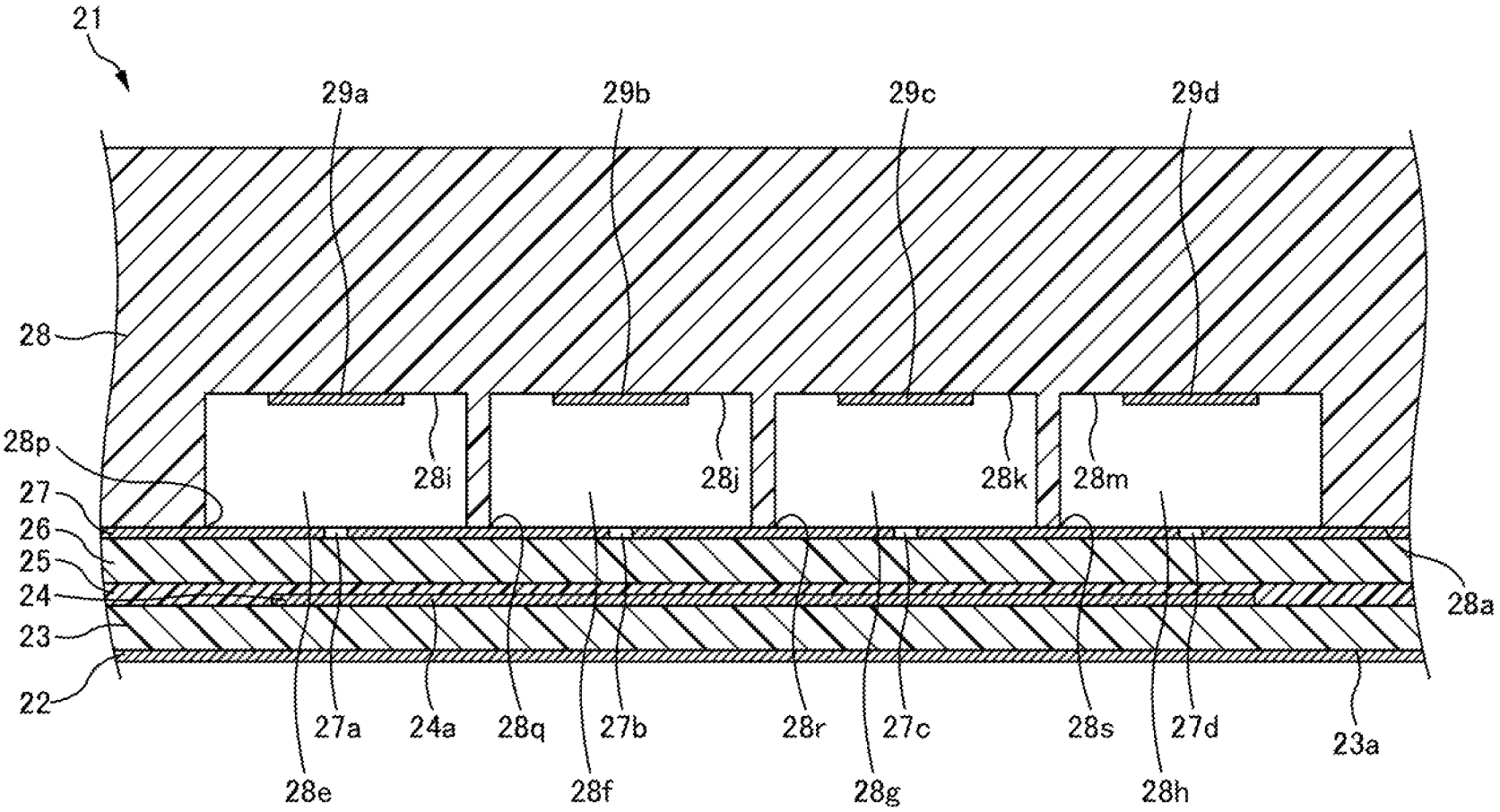
FIG. 24 is a cross-sectional view of an antenna according to a modified example of a second embodiment.

(1) In an embodiment described above, the antenna elements 29*a* to 29*d* are disposed in the single recess 28*b*. In contrast, as illustrated in FIG. 24, the same number of recesses 28*e* to 28*h* as the number of the antenna elements 29*a* to 29*d* may be formed in the bonding surface 28*a* of the dielectric substrate 28, and the antenna elements 29*a* to 29*d* may be individually disposed in the recesses 28*e* to 28*h*, respectively. In this case, the antenna element 29*a* is formed on a bottom 28*i* of the recess 28*e*, the antenna element 29*b* is formed on a bottom 28*j* of the recess 28*f*, the antenna element 29*c* is formed on a bottom 28*k* of the recess 28*g*, and the antenna element 29*d* is formed on a bottom 28*m* of the recess 28*h*. The slot 27*a* is arranged on the inner side with respect to an opening 28*p* of the recess 28*e*. The slot 27*b* is arranged on the inner side with respect to an opening 28*q* of the recess 28*f*. The slot 27*c* is arranged on the inner side with respect to an opening 28*r* of the recess 28*g*. The slot 27*d* is arranged on the inner side with respect to an opening 28*s* of the recess 28*h*. The antenna elements 29*a* to 29*d* face the slots 27*a* to 27*d*, respectively. This improves strength of the dielectric substrate 28 by virtue of portions each between adjacent two of the recesses 28*e* to 28*h*, so that the dielectric substrate 28 is less likely to be deformed. Thus, radiation characteristics of the antenna 21 are stabilized.

(2) In an embodiment described above, there is one group of the antenna elements 29*a* to 29*d*, the slots 27*a* to 27*d*, and the feed line 24*a*. In contrast, there may be a plurality of groups each including the antenna elements 29*a* to 29*d*, the slots 27*a* to 27*d*, and the feed line 24*a*. In this case, the plurality of groups each including the antenna elements 29*a* to 29*d*, the slots 27*a* to 27*d*, and the feed line 24*a* are aligned in a direction orthogonal to a row direction of the antenna elements 29*a* to 29*d*. The positions in the row direction of the antenna elements 29*a* in the groups are aligned, the positions in the row direction of the antenna elements 29*b* in the groups are aligned, the positions in the row direction of the antenna elements 29*c* in the groups are aligned, and the positions in the row direction of the antenna elements 29*d* in the groups are aligned. The antenna elements 29*a* to 29*d* in all of the groups may be arranged in the single recess 28*b*. The antenna elements 29*a* to 29*d* in each of the groups may be arranged in each recess 28*b*. The antenna elements 29*a* to 29*d* may be individually arranged in recesses, respectively. The directivity of an electromagnetic wave can be controlled by controlling the phase of a signal wave of each feed line 24*a*.

(3) In an embodiment described above, the four antenna elements 29*a* to 29*d* are aligned, and the four slots 27*a* to 27*d* are aligned. In contrast, two, six, or more even-number of the antenna elements may be aligned, and the same number of slots as the number of antenna elements may be aligned. In this case, the feed line 24*a* branches into two at a point between the slots adjacent to each other, and the branch line portions 24*f* and 24*h* extend from the point of branch until the branch line portions cross the slots at both ends of the row of the slots in plan view, respectively. The feed line 24*a* preferably branches at a point between the slots adjacent to each other that are positioned in the center of the row of the slots.

REFERENCE SIGNS LIST

1, 21 antenna
4*a*, 24*a* feed line
6, 26 dielectric layer
7, 27 conductive ground layer
7*a*, 27*a*, 27*b*, 27*c*, 27*d* slot

8, 28 dielectric substrate
8*b*, 28*b*, 28*e*, 28*f*, 28*g*, 28*h* recess
8*d*, 28*d*, 28*i*, 28*j*, 28*k*, 28*m* bottom of recess
9, 28*a*-29*d* antenna element
270*a*, 275*a* hole portion
271*a*-274*a*, 276*a*-279*a* cut-out portion

The invention claimed is:

1. An antenna comprising:

dielectric substrate including a recess;

a conductive ground layer bonded to the dielectric substrate so as to cover the recess, the conductive ground layer including a slot that is arranged on an inner side with respect to the recess;

a dielectric layer bonded to the conductive ground layer on a side opposite to the dielectric substrate with respect to the conductive ground layer;

an antenna element formed on a bottom of the recess at position facing the slot; and a feed line formed on a side opposite to the conductive ground layer with respect to the dielectric layer, the feed line configured to be electromagnetically coupled to the antenna element via the slot, wherein the antenna element comprises a plurality of antenna elements, the plurality of antenna elements being aligned at intervals, the slot comprises a plurality of slots, the plurality of slots being aligned at intervals, the antenna elements face the slots, respectively, the number of the antenna elements is an even number, the number of the slots is an even number, and the feed line branches at a point between the slots adjacent to each other that are positioned in the center of a row of the slots, the feed line having branch portions that extend from the point of branch until the branch portions cross the slots at both ends of the row of the slots in plan view, respectively.

2. The antenna according to claim 1, wherein the dielectric substrate is rigid.

3. The antenna according to claim 1, wherein the recess comprises a plurality of recesses, the antenna elements are individually formed on bottoms of the recesses, respectively, and the slots are individually arranged on an inner side with respect to the recesses, respectively.

4. The antenna according to claim 1, wherein the slot is formed in a shape obtained by cutting out, in a rectangular shape or square shape, from both end portions of both long sides of a rectangular hole portion, in a short-side direction.

* * * * *